US006900768B2

(12) United States Patent
Iguchi et al.

(10) Patent No.: US 6,900,768 B2
(45) Date of Patent: May 31, 2005

(54) ANTENNA DEVICE AND COMMUNICATION EQUIPMENT USING THE DEVICE

(75) Inventors: Akihiko Iguchi, Osaka (JP); Yuki Satoh, Osaka (JP); Susumu Fukushima, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 12 days.

(21) Appl. No.: 10/433,076

(22) PCT Filed: Sep. 18, 2002

(86) PCT No.: PCT/JP02/09573

§ 371 (c)(1),
(2), (4) Date: May 30, 2003

(87) PCT Pub. No.: WO03/028149

PCT Pub. Date: Apr. 3, 2003

(65) Prior Publication Data

US 2004/0027298 A1 Feb. 12, 2004

(30) Foreign Application Priority Data

Sep. 25, 2001 (JP) ..... 2001-291604

(51) Int. Cl.[7] ..... H01Q 1/24
(52) U.S. Cl. ..... 343/702; 343/895; 455/575.7
(58) Field of Search ..... 343/700 MS, 702, 343/833, 895; 455/575.7

(56) References Cited

U.S. PATENT DOCUMENTS

| | | | | |
|---|---|---|---|---|
| 5,451,965 | A | 9/1995 | Matsumoto | 343/702 |
| 6,172,646 | B1 * | 1/2001 | Kawahata et al. | 343/702 |

FOREIGN PATENT DOCUMENTS

| | | |
|---|---|---|
| EP | 0508567 | 10/1992 |
| EP | 802577 | 10/1997 |
| EP | 1098387 | 5/2001 |
| JP | 10-190330 | 7/1998 |
| JP | 11-186833 | 7/1999 |
| JP | 2000-278036 | 10/2000 |
| WO | WO 00/30267 | 5/2000 |

OTHER PUBLICATIONS

Japanese International Search Report for PCT/JP02/09573, dated Jan. 14, 2003.
English translation of Japanese International Search Report for PCT/JP02/09573, dated Jan. 14, 2003.

* cited by examiner

*Primary Examiner*—Michael C. Wimer
(74) *Attorney, Agent, or Firm*—RatnerPrestia

(57) ABSTRACT

An antenna device which includes the first antenna element having one end open and the other end connected to a power feeder, and the second antenna element, having both ends open. The second antenna element is disposed on the outer peripheral surface of the first antenna element in insulated state. The other end of the first antenna element is connected to the power feeder through the first ring-shaped conductor.

12 Claims, 8 Drawing Sheets

ANTENNA DEVICE AND COMMUNICATION EQUIPMENT USING THE DEVICE

THIS APPLICATION IS A U.S. NATIONAL PHASE APPLICATION OF PCT INTERNATIONAL APPLICATION PCT/JP02/09573.

TECHNICAL FIELD

The present invention relates to antenna devices mainly employed in wireless equipment such as for mobile communications, and communications equipment using the antenna device.

BACKGROUND ART

The market for wireless mobile equipment such as mobile phones and pagers continues to expand rapidly. The antenna is built into the cabinet in some types of mobile wireless equipment. One example of such mobile wireless equipment is a mobile phone with a built-in antenna, and an inverted-F antenna is generally the antenna device employed. In mobile phones, an antenna device which can send and receive more than one frequency band is needed due to the increased use of compound terminals.

FIG. 9 shows conventional inverted-F antenna 100 popularly used as a built-in antenna. Inverted-F antenna 100 shown in FIG. 9 consists of base substrate 101, radiating conductive element 102, shorting part 103 for shorting base substrate 101 and radiating conductive element 102, and power feeder 104 for supplying power to the antenna.

However, the above inverted-F antenna 100 has a narrow frequency band, and can only be used at a single frequency. In addition, to broaden the frequency band, the distance between radiating conductive element 102 and base substrate 101 needs to be extended or radiating conductive element 102 itself needs to be enlarged. It is thus extremely difficult to achieve both downsizing and broader bandwidth.

DISCLOSURE OF INVENTION

The present invention offers an antenna device that includes a first antenna element having one end open and the other end connected to a power feeder, and a second antenna element having both ends open. The second antenna element is disposed on the outer peripheral face of the first antenna element in insulated state. The other end of the first antenna element is connected to the power feeder through a first ring-shaped conductor.

DETAILED DESCRIPTION OF PREFERRED EMBODIMENT(S)

Exemplary embodiments of the present invention are described below with reference to drawings.

First Exemplary Embodiment

Figure 1:
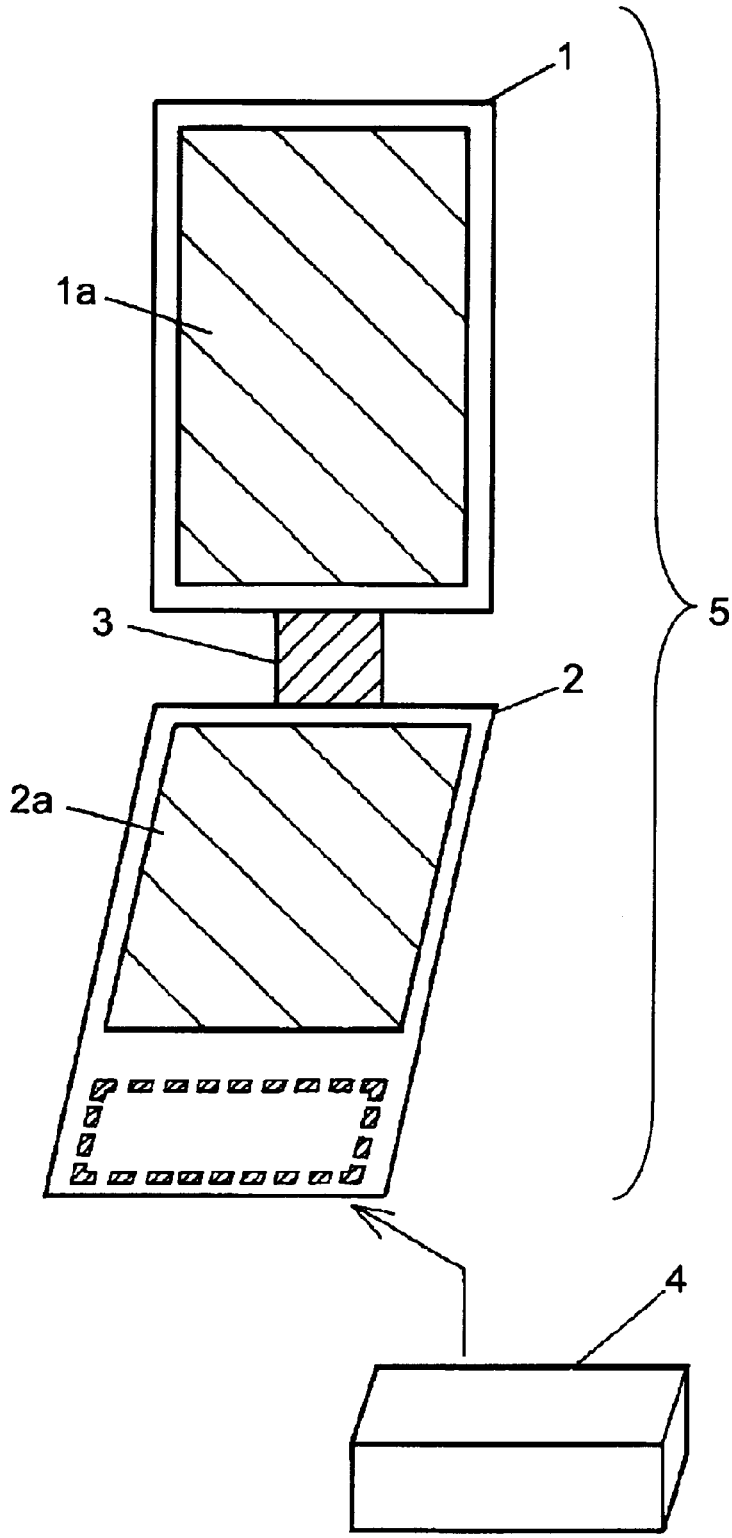
FIG. 1 is an external perspective illustrating the structure of communications equipment in accordance with a first exemplary embodiment of the present invention.
Figure 2:
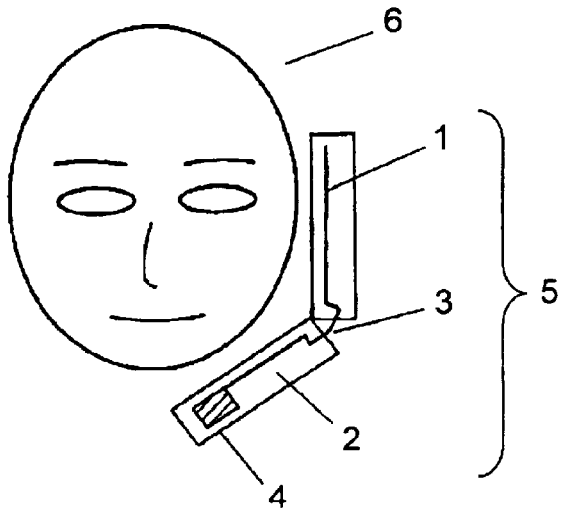
FIG. 2 is an example of the use of communications equipment in accordance with the first exemplary embodiment of the present invention.
Figure 3:
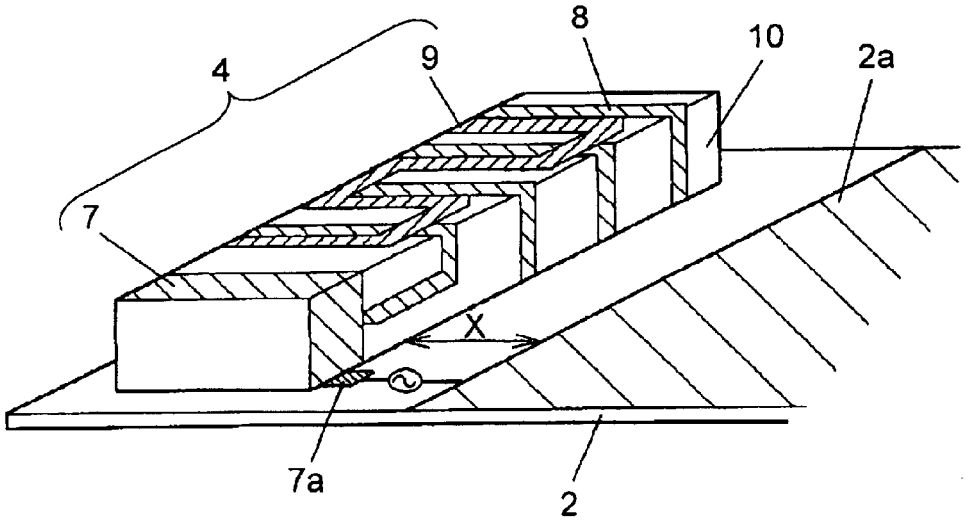
FIG. 3 is a fragmentary perspective of an antenna device in accordance with the first exemplary embodiment of the present invention.

FIGS. 1 to 3 show a first exemplary embodiment of the present invention.

In FIG. 1, first substrate 1 has ground pattern 1*a*, and second substrate 2 also has ground pattern 2*a*. Connector 3, made of a conductor, has a hinge structure and is connected to ground patterns 1*a* and 2*a*.

Antenna device 4 is mounted on second substrate 2 in a dotted area using a predetermined mounting method. A part of ground patterns 1*a* and 2*a* are then patterned (not illustrated) to mount components for communications and interface such as wireless circuits, modulator circuits, control circuits, microphones, speakers, and LCDs.

Communications equipment 5 for wireless communications is constructed by connecting these components to antenna device 4. Communications equipment 5 can, for example, establish communications in the style shown in FIG. 2. In FIG. 2, antenna device 4 is disposed near the mouth of user 6.

Antenna device 4 is structured as shown in FIG. 3.

Ring-shaped element 7 is a conductor, which is a first conductive part, and has power feeder 7*a*. Helical element 8 is a conductor, which is a first antenna element, and has one end open and the other end connected to the ring-shaped element.

Meander element 9 is a conductor, which is a second antenna element, and has both ends open. This meander element 9 is disposed on an outer peripheral face of helical element 8 in an insulated state for direct current.

Insulator 10 has ring-shaped element 7, helical element 8 and meander element 9.

In FIG. 3, helical element 8 and meander element 9 are electromagnetically coupled to each other at high frequency. The length of each element and the gap between these elements are adjustable in a way so as to resonate, for example, in the 900 MHz band and the 1.9 GHz band. The antenna is thus operable at multiple bands.

In addition, the integration of ring-shaped element 7 and power feeder 7*a* allows ring-shaped element 7 to function as a distributed constant circuit of a high frequency circuit, demonstrating an effect as a matching circuit.

Figure 4A:
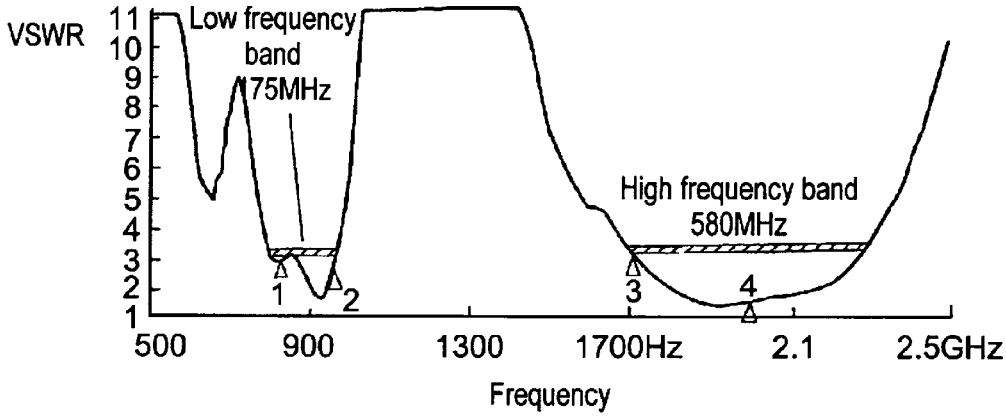
FIGS. 4A and 4B show characteristics of the antenna device in accordance with the first exemplary embodiment of the present invention.
Figure 4B:
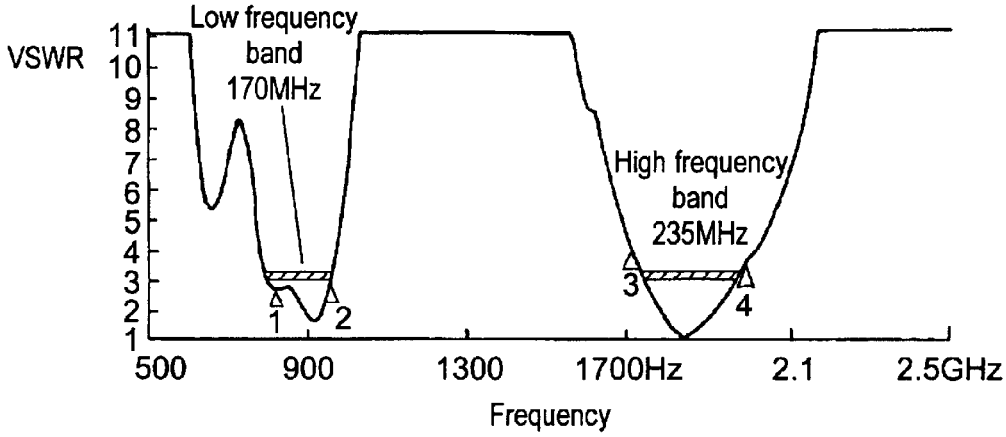

FIGS. 4A and 4B show the measurement results of the effect of ring-shaped element 7. FIGS. 4A and 4B show the frequency characteristics of antenna device 4 when impedance matching is VSWR. It is apparent that impedance matching is better when the VSWR value is smaller and close to 1.

FIG. 4A is for antenna device 4 with ring-shaped element 7, and FIG. 4B is for antenna device 4 without ring-shaped element 7. Comparison is made using first substrate 1, second substrate 2, connector 3, and antenna device 4 of the same size for both. It is apparent from FIG. 4 that the use of ring-shaped element 7, when the VSWR value is 3 or smaller, enables the broadening of the frequency band: 170

MHz to 175 MHz in the low frequency band, and 235 MHz to 580 MHz in the high frequency band. In other words, antenna device 4 can achieve a sufficiently broad band even after downsizing by using ring-shaped element 7, in spite of the frequency band generally becoming narrower when the size of the antenna element is reduced.

FIGS. 4A and 4B show the result when the antenna device is equipped with helical element 8 and meander element 9, and demonstrates that the antenna device is operable in dual bands of 800 to 1000 MHz and 1.7 to 2.3 GHz. Accordingly, the structure described in the first exemplary embodiment offers an antenna device and communications equipment that are small and operable at multiple wide-bands.

Although not illustrated in the first exemplary embodiment, the addition of a second ring-shaped element, same as ring-shaped element 7, to an open end of helical element 8 enables the second ring-shaped element, which is a second conductor, to resonate at the same frequency even if the length of helical element 8 is reduced. An even smaller antenna device 4 is thus achievable.

In the first exemplary embodiment, ring-shaped element 7, helical element 8, and meander element 9 can be made using a press method for punching out a metal piece into a specific shape. The use of copper for the metal piece confers good workability and low electrical conductivity loss. Accordingly, antenna device 4 with good efficiency and less variation is easily manufactureable.

Other than the above method, the present invention can also be easily manufactured through patterning using conductive paste and etching. Similar effects are achievable.

For insulator 10, a material with relative dielectric constant of 5 or less, such as ABS resin, phenol, polycarbonate, and tetrafluoroethylene is preferable. An effective dielectric constant of 5 or less is also achievable by hollowing out a central part of the material.

This structure makes it possible to achieve good impedance characteristics and antenna radiation characteristics. In addition, if the material is hollowed out, even lighter antenna device 4 is achievable.

Figure 5:
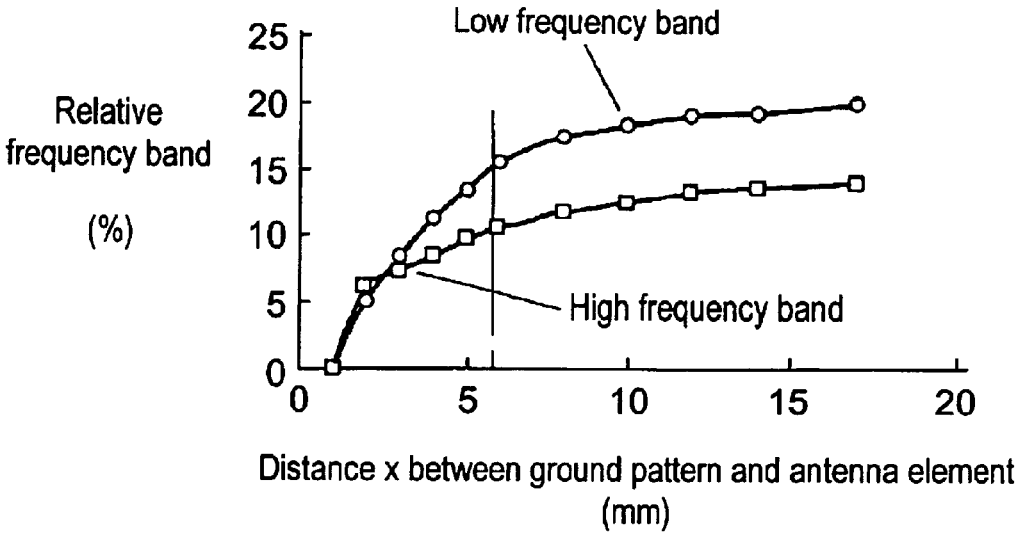
FIG. 5 shows characteristics of the antenna device in accordance with the first exemplary embodiment of the present invention.

FIG. 5 shows changes in a relative frequency band when the VSWR value is 3 or smaller and distance x between ground pattern 2 and antenna device 4 in FIG. 3 is varied. It is apparent from FIG. 5 that the relative frequency band is less dependent on x when x becomes about 6 mm or greater. Accordingly, an antenna device with stable characteristics even using broader bandwidth is achievable by setting 6 mm or greater for x.

In the first exemplary embodiment, FIG. 3 illustrates the case when meander element 9 is disposed at the top as viewed in the drawing. If meander element 9 is disposed at the opposite side of ground pattern 2*a*, i.e. at the rear face in the drawing, the distance between meander element 9 and ground pattern 2*a* can be increased. Accordingly, antenna device 4 with even broader band and higher performance is achievable.

Second Exemplary Embodiment

Figure 6:
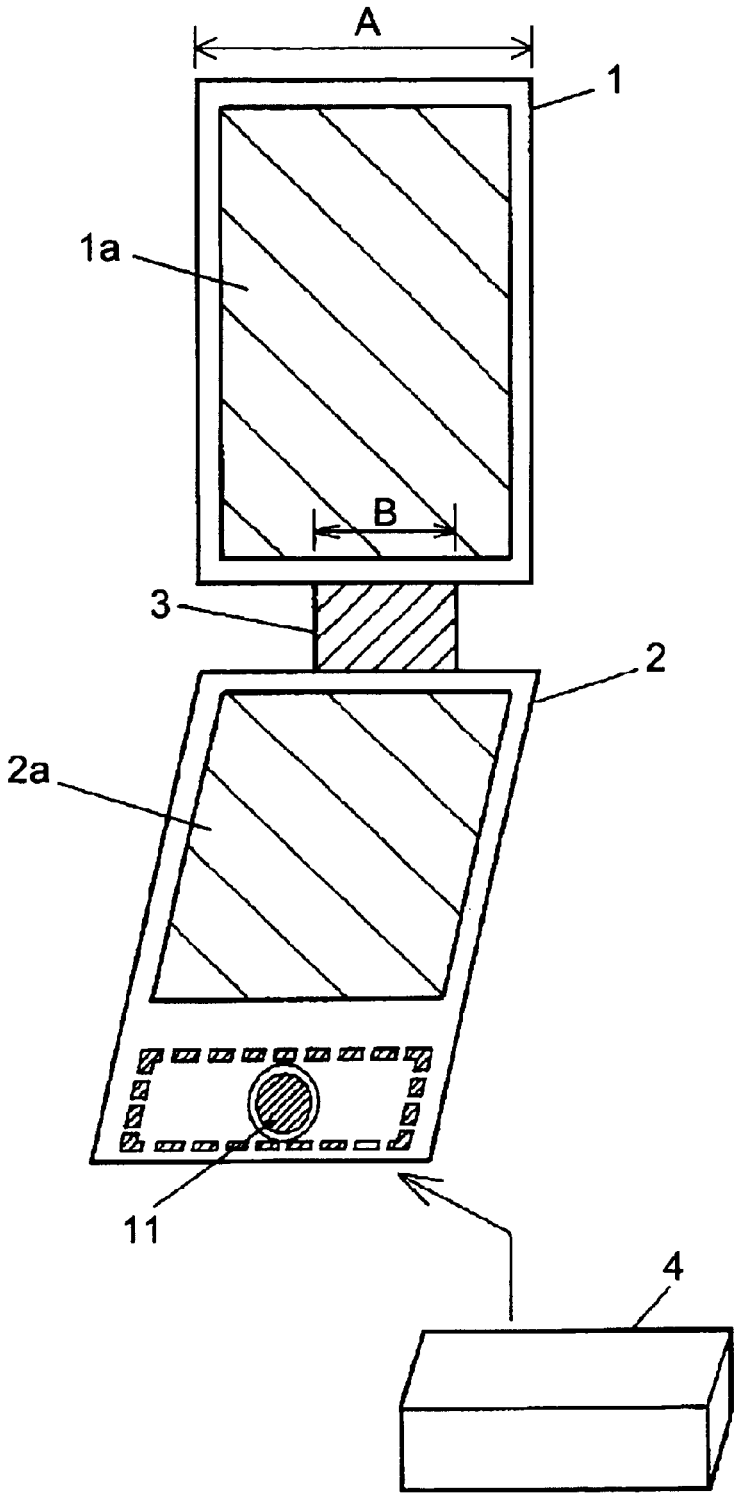
FIG. 6 is an external perspective illustrating the structure of communications equipment in accordance with a second exemplary embodiment of the present invention.

A second exemplary embodiment of the present invention is shown in FIG. 6.

The structure described in the first exemplary embodiment is omitted from the description in the second exemplary embodiment. The first characteristic of the structure in the second exemplary embodiment is that the horizontal width B of connector 3 is made ⅓ or longer of horizontal width A of first substrate 1 and second substrate 2. Current distribution when the horizontal width of connector 3 is varied is studied using an electromagnetic field simulation. As a result, a relatively large high-frequency current is distributed on and near connector 3. This is significantly affected by gripping this part with the hand, and the impedance characteristic is also narrowed. If B shown in FIG. 6 is set to about ⅓ of A, the concentration of high-frequency current is greatly reduced, solving the above disadvantage.

Figure 7:
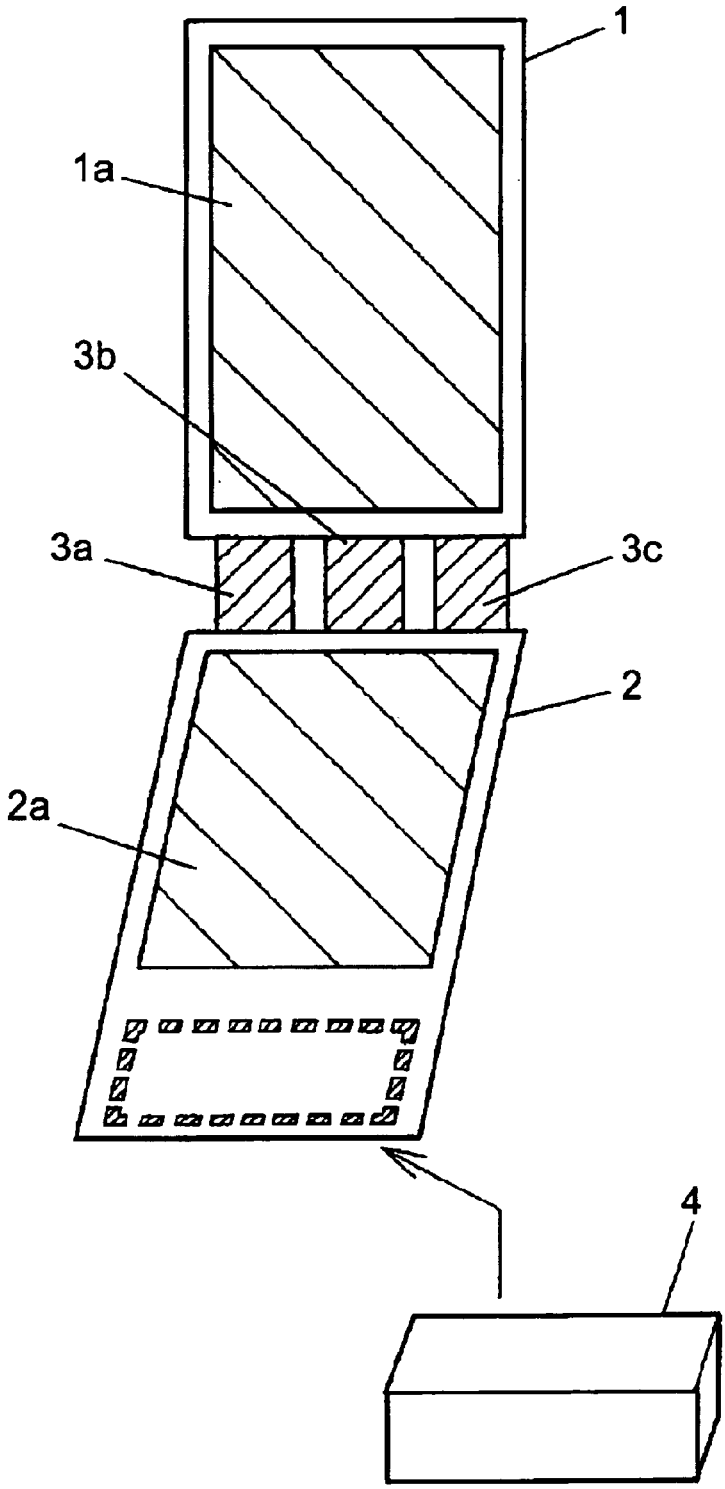
FIG. 7 is an external perspective illustrating another structure in accordance with the second exemplary embodiment of the present invention.

A similar effect is achievable by configuring connector 3 with multiple members 3*a*, 3*b*, and 3*c* as shown in FIG. 7.

The second characteristic of the second exemplary embodiment shown in FIG. 6 is that antenna device 4 is mounted at a position overlapping microphone 11.

Recently, the size of microphone 11 has shrunk to a diameter of 7 mm or less, and the influence of microphone 11 is relatively small even if antenna device 4 is mounted in an overlapping position. The required characteristics can be sufficiently satisfied by adjusting the shape and mutual positional relationship of ring-shaped element 7, helical element 8, and meander element 9. The size of second substrate 2 can be reduced by mounting antenna device 4 such that it overlaps microphone 11. Accordingly, even smaller communications equipment is made feasible.

Third Exemplary Embodiment

Figure 8:
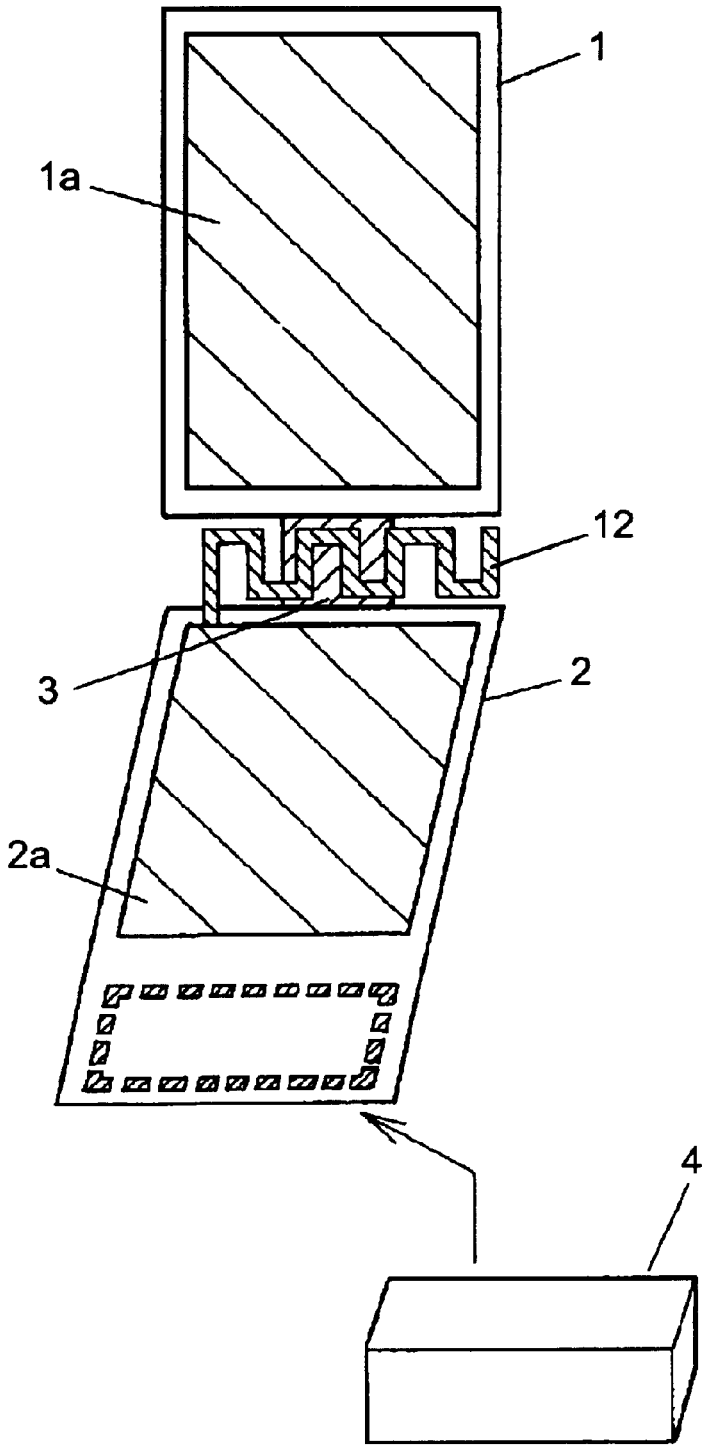
FIG. 8 is an external perspective illustrating the structure of communications equipment in accordance with a third exemplary embodiment of the present invention.
Figure 9:
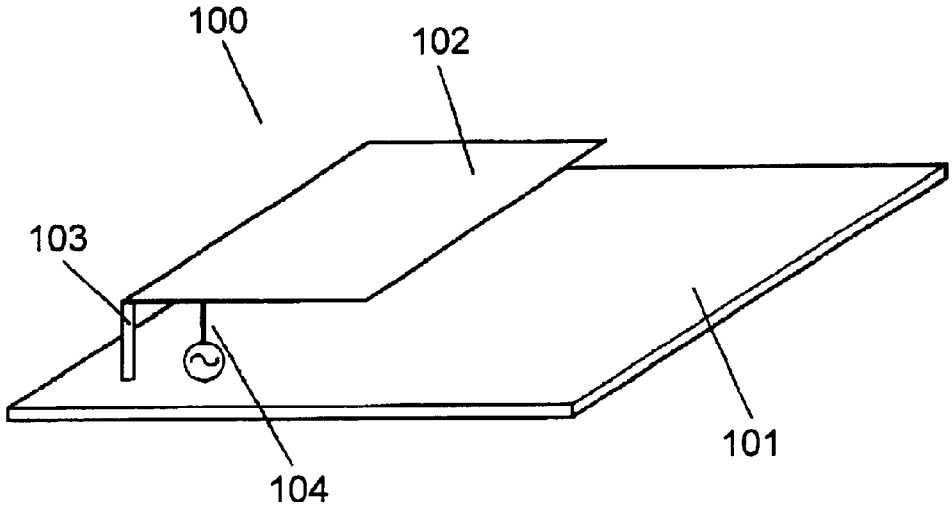
FIG. 9 PRIOR ART
FIG. 9 is a perspective illustrating the structure of a conventional antenna device.

A third exemplary embodiment of the present invention is shown in FIG. 8. The structure already described in the first and second exemplary embodiments is omitted from description in the third exemplary embodiment.

The characteristic of the third exemplary embodiment is that another antenna element 12 is disposed at the hinge of communications equipment where connector 3 is provided. One end of antenna element 12 is connected to ground pattern 2*a* and the other end is open. The part where connector 3 is provided has extremely high high-frequency current density, as described in the second exemplary embodiment. Accordingly, radiation characteristics can be improved and broader bandwidth is achieved overall by providing antenna element 12, which is a radiating element, to this part.

The third exemplary embodiment refers to a meander element in the drawing. However, the same effect is achievable with other shapes such as linear or spiral elements.

Also in the third exemplary embodiment, antenna element 12 is connected to ground pattern 2*a*. The same effect is also achievable when antenna element 12 is connected to ground pattern 1*a*.

As described above, the present invention offers a small and broad-band antenna device applicable to multiple frequencies, and wireless communications equipment using such antenna device by providing ring-shaped element, helical element, and meander element in a structure described above.

In addition, even broader band characteristics are achievable at selected frequencies by optimizing the positions of the shorting part and power feeder and the size and position of each element.

INDUSTRIAL APPLICABILITY

The present invention relates to the antenna device mainly used in wireless equipment such as for mobile communications and communications equipment using such device, and offers a small broad-band antenna device applicable to multiple frequencies and wireless communications equipment using this antenna device.

What is claimed is:

1. Communications equipment of a folding type in which a speaker and a microphone are separately disposed, said communications equipment comprising:

a first substrate and a second substrate on which circuitry for controlling said communications equipment is formed, said first substrate and said second substrate being respectively disposed inside a respective cabinet at said speaker side and said microphone side;

a first ground pattern and a second ground pattern provided on one of single and both faces of each of said first substrate and said second substrate;

a connector made of a conductor for electrically coupling said first ground pattern and said second ground pattern; and a antenna device mounted on at least one of said first substrate and said second substrate;

said antenna device including:

a) a first antenna element or which one end is open and another end is connected to a power feeder, and a second antenna element having both ends open, said second antenna element placed at an outer peripheral face of said first antenna element and electrically insulated; and b) said first antenna element of which end other than open end is connected to said power feeder via a first ring-shaped element.

2. The communications equipment as defined in claim 1, wherein a width of said connector is not less than ⅓ of a width of one of said first ground pattern and said second ground pattern.

3. The communications equipment as defined in claim 1, wherein said connector is made of a plurality of conductors with one of same and different widths.

4. The communications equipment as defined in claim 1, wherein a conductor is formed one of spirally and linearly near a part configuring said connector of said antenna device, said conductor having one end connected to one of said first ground pattern and said second ground pattern, and the other end open.

5. The communications equipment as defined in claim 1, wherein said antenna device is disposed at a position one of partially and entirely overlapping said microphone.

6. The communications equipment as defined in claim 1, wherein said antenna device is consisted with said first and said second substrates on which circuitry for controlling said communication equipment is formed, said first and second substrates have a ground pattern at one side or both sides said power feeder of said antenna device and a part of said circuitry is electrically connected when assembled, and said antenna device and said ground pattern is not directly or indirectly overlapped.

7. The communications equipment as defined in claim 6 wherein said antenna device is placed with minimum distance of more than 6 mm from said ground pattern.

8. The communications equipment as defined in claim 2, wherein said connector is made of a plurality of conductors with one of same and different widths.

9. The communications equipment as defined in claim 2, wherein a conductor is formed one of spirally and linearly near a part configuring said connector of said antenna device, said conductor having one end connected to one of said first ground pattern and said second ground pattern, and the other end open.

10. The communications equipment as defined in claim 2 wherein said antenna device is disposed at a position one of partially and entirely overlapping said microphone.

11. The communications equipment of claim 1, wherein said open end of said first antenna element includes a second ring-shaped element which is open.

12. The communications equipment as defined in claim 11, wherein a width of said connector is not less than ⅓ of a width of one of said first ground pattern and said second ground pattern.

* * * * *